US009695793B2

(12) United States Patent
Kernwein

(10) Patent No.: US 9,695,793 B2
(45) Date of Patent: Jul. 4, 2017

(54) CORONA IGNITION SYSTEM FOR AN INTERNAL COMBUSTION ENGINE AND METHOD FOR CONTROLLING A CORONA IGNITION SYSTEM

(71) Applicant: BorgWarner Ludwigsburg GmbH, Ludwigsburg (DE)

(72) Inventor: Markus Kernwein, Bretten (DE)

(73) Assignee: BORGWARNER LUDWIGSBURG GMBH, Ludwigsburg (DE)

( * ) Notice: Subject to any disclaimer, the term of this patent is extended or adjusted under 35 U.S.C. 154(b) by 384 days.

(21) Appl. No.: 14/516,056

(22) Filed: Oct. 16, 2014

(65) Prior Publication Data

US 2015/0114371 A1 Apr. 30, 2015

(30) Foreign Application Priority Data

Oct. 31, 2013 (DE) ..... 10 2013 112 039

(51) Int. Cl.
*F02P 23/04* (2006.01)
*F02P 9/00* (2006.01)
*F02P 7/02* (2006.01)

(52) U.S. Cl.
CPC ..... *F02P 23/04* (2013.01); *F02P 9/002* (2013.01); *F02P 7/02* (2013.01)

(58) Field of Classification Search
CPC .. F02P 3/01; F02P 9/007; F02P 23/045; F02P 23/04; F01N 2240/28
USPC ..... 123/143 B, 297, 536, 634, 623
See application file for complete search history.

(56) References Cited

U.S. PATENT DOCUMENTS 2,968,296 A * 1/1961 Kaehni ..... F02P 3/0552 123/606
3,934,566 A * 1/1976 Ward ..... F02P 9/007 123/143 B
4,333,125 A * 6/1982 Hensley ..... F02P 7/03 313/138
4,398,526 A * 8/1983 Hamai ..... F02P 9/007 123/143 B
4,402,036 A * 8/1983 Hensley ..... F02P 7/03 313/138

(Continued)

FOREIGN PATENT DOCUMENTS

DE 20 2010 045 168 A1 3/2012

*Primary Examiner* — Sizo Vilakazi
*Assistant Examiner* — Brian Kirby
(74) *Attorney, Agent, or Firm* — Bose McKinney & Evans LLP

(57) ABSTRACT

A corona ignition system for igniting fuel in a combustion chamber of an internal combustion engine, comprising a oscillating circuit, which contains an ignition electrode, a high-frequency generator, which is connected to the oscillating circuit, in order to produce an AC voltage to excite the oscillating circuit, a converter in order to produce an input voltage for the high-frequency generator from an on-board supply voltage, a voltage controller to stabilize the input voltage produced by the converter for the high-frequency generator, and a control unit for controlling the high-frequency generator, wherein the control unit communicates an imminent load change of the converter to the voltage regulator, before the load change occurs as a result of activation or deactivation of the high-frequency generator. A method for controlling a corona ignition system is also described.

8 Claims, 1 Drawing Sheet

(56) References Cited

U.S. PATENT DOCUMENTS 4,996,967 A * 3/1991 Rosswurm ..... F02P 9/007 123/598
5,655,210 A * 8/1997 Gregoire ..... C02F 1/4608 210/748.01
6,883,306 B2 * 4/2005 Kim ..... F01N 3/0892 60/274
6,883,507 B2 * 4/2005 Freen ..... F02C 7/266 123/143 B
7,900,613 B2 * 3/2011 Heuermann ..... F02P 23/045 123/606
8,550,059 B2 * 10/2013 Makarov ..... F02P 9/007 123/606
2004/0129241 A1 * 7/2004 Freen ..... F02C 7/266 123/143 B
2004/0263412 A1 * 12/2004 Pribyl ..... H01J 37/32082 343/866
2008/0286496 A1 * 11/2008 Ramm ..... C23C 14/0021 427/580
2010/0026186 A1 * 2/2010 Forrest ..... H01J 37/32045 315/111.21
2010/0206277 A1 * 8/2010 Kajita ..... F02P 9/007 123/620
2010/0282198 A1 * 11/2010 Hampton ..... F02P 9/002 123/143 B
2011/0114071 A1 * 5/2011 Freen ..... F02P 17/12 123/623
2011/0175691 A1 * 7/2011 Smith ..... F02P 9/007 333/222
2011/0253114 A1 * 10/2011 Schremmer ..... F02P 23/04 123/606
2012/0055430 A1 * 3/2012 Braeuchle ..... F02P 23/045 123/143 B
2012/0260898 A1 * 10/2012 Schremmer ..... F02P 3/06 123/598
2013/0073180 A1 * 3/2013 Murase ..... F01N 3/01 701/102
2015/0114371 A1 * 4/2015 Kernwein ..... F02P 9/002 123/623

* cited by examiner

CORONA IGNITION SYSTEM FOR AN INTERNAL COMBUSTION ENGINE AND METHOD FOR CONTROLLING A CORONA IGNITION SYSTEM

RELATED APPLICATIONS

This application claims priority to DE 10 2013 112 039.3, filed Oct. 31, 2013, which is hereby incorporated herein by reference in its entirety.

BACKGROUND

The invention relates to a corona ignition system and to a method for controlling a corona ignition system.

US 2011/0114071 A1 discloses a corona ignition system with which a fuel/air mixture in a combustion chamber of an internal combustion engine can be ignited by a corona discharge produced in the combustion chamber. This corona ignition system has an ignition electrode, which protrudes from an insulator. The ignition electrode, the insulator and a sleeve surrounding the insulator form an electrical capacitor. This capacitor is part of an electrical oscillating circuit of the corona ignition device. The oscillating circuit is excited with a high-frequency AC voltage for example from 30 kHz to 50 MHz causing a voltage excess at the ignition electrode so that a corona discharge forms at the ignition electrode.

The high-frequency AC voltage is produced by a high-frequency generator. The input voltage of the high-frequency generator is produced by a converter from the on-board supply voltage of the vehicle. The input voltage of the high-frequency generator generally lies in the range from 100 V to 400 V in the case of known corona ignition systems.

A corona discharge forms ions and radicals in a fuel/air mixture in the combustion chamber of an engine. When a critical concentration of ions and radicals is reached, the fuel/air mixture ignites. The rate at which ions and radicals are produced is dependent on the size of the corona discharge and the electrical power thereof. The size and power of a corona discharge can only increase up to a critical limit. If this limit is exceeded, the corona discharge transitions into an arc discharge or spark discharge.

For this reason corona ignition systems are controlled such that the corona discharge is as large as possible, but a breakdown of the corona discharge into an arc or spark discharge is avoided. The fuel/air mixture can then be ignited as quickly as possible and the ignition moment can thus be predefined as precisely as possible.

SUMMARY

This disclosure teaches a way for improving control of a corona ignition system.

These teachings make it possible to predefine the power introduced into the combustion chamber by a corona discharge with a greater precision. This is achieved by controlling the output voltage of the converter to a target value using a controller and by communicating an imminent load change of the converter to the controller, before the load change occurs as a result of activation or deactivation of the high-frequency generator. The activation of the high-frequency generator, due to the associated rapid change in load, leads specifically to a temporary voltage drop. This voltage drop can be reduced by increasing the target value of the output voltage in expectation of the voltage drop. The deactivation of the high-frequency generator leads to a temporary voltage excess, which can be reduced by reducing the target value of the output voltage in expectation of the voltage excess.

Voltage fluctuations of the input voltage of the high-frequency generator lead to corresponding fluctuations of the output voltage thereof and therefore also to fluctuations in the power of the oscillating circuit and therefore of the corona discharge. If the output voltage of the converter and therefore the input voltage of the high-frequency generator is stabilized, the power of the corona discharge and of the ignition moment can therefore be controlled with higher precision.

The target value may always be changed by a constant, load-independent magnitude whenever there is an imminent load change. A control of this type can be implemented with little effort and can already significantly compensate for load-induced voltage fluctuations, in particular if the expected load changes are always of substantially the same size. However, in the case of an imminent load change, the target value can also be changed by a magnitude that is defined individually by the control unit of the corona ignition system, in each case in dependence of the size of the expected load change.

An imminent load change can be communicated to the controller of the converter for example 2 to 200 microseconds prior to the activation or deactivation of the high-frequency generator.

In accordance with an advantageous refinement of this disclosure, the voltage controller responds to a communication of a control unit concerning an imminent load change by changing a target value specification in steps. A greater change to the target value can thus be broken down into a number of small, successive changes. The individual steps may be so small that the target value specification is changed in a ramp-like manner, for example. Transient effects can be mitigated by a change to the target value in steps.

When the target value is changed, one embodiment may, for example, provide that at least one step is performed prior to the ignition of the corona discharge and at least one step after the ignition of the corona discharge. For example, the corona discharge can be ignited whilst the target value is changed in a ramp-like manner. In this way, a large energy can be applied from the start of a corona discharge and still a small overshoot achieved.

It is possible to respond symmetrically to an anticipated load increase and to an anticipated load decrease of identical size, in other words the momentary target value can be increased or reduced by the same magnitude. However, it is also possible to respond to load increases with a stronger or weaker change of the target value compared with load decreases.

BRIEF DESCRIPTION OF THE DRAWINGS

The above-mentioned aspects of exemplary embodiments will become more apparent and will be better understood by reference to the following description of the embodiments taken in conjunction with the accompanying drawings, wherein.

DESCRIPTION

The embodiments described below are not intended to be exhaustive or to limit the invention to the precise forms disclosed in the following detailed description. Rather, the embodiments are chosen and described so that others skilled in the art may appreciate and understand the principles and practices of this disclosure.

Figure 1:
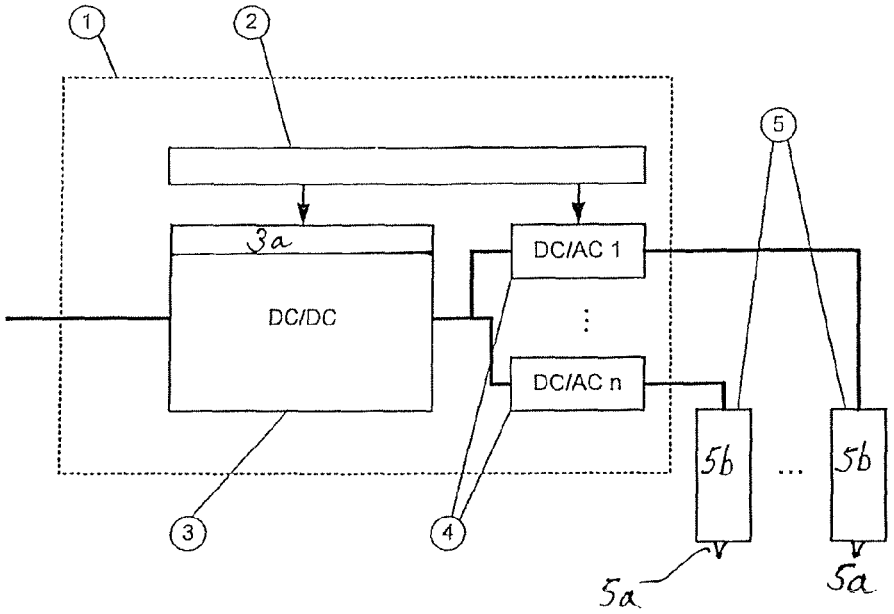
FIG. 1 shows a schematic illustration of a corona ignition system.

The corona ignition system illustrated schematically in FIG. 1 comprises a central unit 1 and a plurality of igniters 5, which are connected to the central unit 1 and which each contain a oscillating circuit 5*b* with an ignition electrode 5*a*. Each of these igniters 5 is associated with a combustion chamber of the engine and produces a corona discharge at the ignition electrode 5*a* thereof.

The central unit 1 comprises a converter 3, a plurality of high-frequency generators 4, which are connected to the converter 3 and which are each connected to one of the individual igniters 5, a control unit 2 and a voltage controller 3*a*. The converter 3, for example a DC/DC converter, converts an on-board supply voltage of the vehicle into an input voltage for the high-frequency generators 4. The voltage produced by the converter 3 is regulated by a voltage controller 3*a* to a target value. The voltage controller 3*a* can be integrated in the converter 3.

The input voltage of the high-frequency generator 4 is usually greater than the on-board supply voltage. The converter 3 thus generates a higher output voltage from an input voltage. The converter 3 may comprise a number of steps. Here, it is possible for all steps to be formed as step-up converters, that is to say to produce a higher output voltage from an input voltage. It is also possible for one or more steps, for example the last step of the converter, to be formed as step-down converters.

The high-frequency generators 4 are controlled by a control unit 2. The control unit 2 activates the high-frequency generators 4 when a corona discharge is to be produced in the relevant combustion chamber of the motor. Load changes of the converter 3 are produced by the activation and deactivation (which alternate in the engine cycle) of the high-frequency generators 4. The course of the loading of the converter 3 is illustrated schematically in FIG. 2*a*) and is produced as a result of an activation and subsequent deactivation of a high-frequency generator 4.

Figure 2:
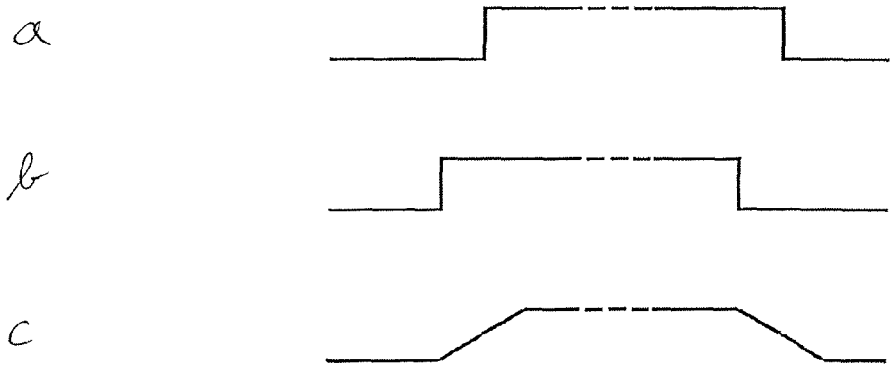
FIG. 2 shows a schematic illustration of the course of load, load signal and the target value of the voltage regulator.

This loading is known beforehand to the control unit 2, since the high-frequency generators 4 are activated and deactivated at predefined times in the engine cycle. The control unit 2 communicates an imminent load change of the converter 3 to the voltage controller 3*a*, before the load change occurs as a result of activation or deactivation of the high-frequency generator 4. This is illustrated in FIG. 2*b*) by a load signal, which precedes the load illustrated in FIG. 2*a*), for example by 2 to 400 microseconds, preferably 2 to 200 microseconds. The voltage controller 3*a* responds to an imminent load change with a stepwise change to the target value to which the voltage produced by the converter 3 is regulated. Here, the steps can be selected so as to be so small that a ramp-like change to the target value is produced, as is illustrated schematically in FIG. 2 *c*).

The voltage controller 3*a* responds to the load signal shown in FIG. 2*b*) with the change to the target value sketched in FIG. 2*c*). An imminent increase of the load prompts the voltage controller 3*a* to increase the target value in steps. An imminent load decrease due to a deactivation of a high-frequency generator 4 prompts the voltage controller 3*a* to reduce, in steps, the target value to which the voltage produced by the converter 3 is regulated.

A sudden load change, as occurs with the activation and deactivation of a high-frequency generator 4, leads specifically to a temporary voltage drop or a voltage excess. This can be compensated for by a prior change to the target value. An increase of the load leads specifically to an increased amperage, which leads to a charging of inductors. The power necessary to charge the inductors is not available to the load, that is to say the high-frequency generator. Since the target value of the voltage is increased before the high-frequency generator 4 is activated, the inductors can be charged at least partially before this loads the converter 3.

Similarly, a load decrease leads to a discharging of inductors, which may result in a voltage increase. Since the target value of the voltage is reduced prior to a deactivation of a high-frequency generator 4, a voltage excess can be reduced.

A corona discharge is ignited in the illustrated embodiment during a ramp-like change of the target value. In other words, some steps of the change to the target value are performed prior to the ignition of the corona discharge and some steps of the change to the target value are performed after the ignition of the corona discharge.

While exemplary embodiments have been disclosed hereinabove, the present invention is not limited to the disclosed embodiments. Instead, this application is intended to cover any variations, uses, or adaptations of this disclosure using its general principles. Further, this application is intended to cover such departures from the present disclosure as come within known or customary practice in the art to which this invention pertains and which fall within the limits of the appended claims.

What is claimed is:

1. A corona ignition system for igniting fuel in a combustion chamber of an internal combustion engine, comprising:

an oscillating circuit containing an ignition electrode;

a high-frequency generator connected to the oscillating circuit and configured to produce an AC voltage for exciting the oscillating circuit;

a converter configured to produce an input voltage for the high-frequency generator;

a voltage controller configured to stabilize the input voltage produced by the converter for the high-frequency generator at a target value;

a control unit configured for controlling the high-frequency generator;

wherein the control unit is configured to communicate an imminent load change of the converter to the voltage controller, before the load change resulting from activation or deactivation of the high-frequency generator occurs; and wherein the voltage controller is configured to respond to a communication of the control unit concerning an imminent load change by changing the target value to a changed target value and the converter begins producing the input voltage for the high-frequency generator at the changed target value before occurrence of the imminent load change.

2. The corona ignition system according to claim 1, wherein the control unit is configured to communicate the imminent load change to the voltage regulator two microseconds to two hundred microseconds prior to the activation or deactivation of the high-frequency generator.

3. The corona ignition system according to claim 1, wherein the voltage controller is configured to respond to a communication of the control unit concerning an imminent load change by changing the target value in steps.

4. A method for controlling a corona ignition system, wherein a corona discharge is produced at an ignition electrode, an input voltage of a high-frequency generator is provided by a converter, and an oscillating circuit containing the ignition electrode is excited with an output voltage of the high-frequency generator, wherein the input voltage of the high-frequency generator is regulated with a voltage controller to a target value, an imminent load change is communicated to the voltage controller, before the high-frequency generator is activated or deactivated, in order to mitigate voltage drops in the case of an activation of the high-frequency generator and voltage excesses in the case of a deactivation of the high-frequency generator; and wherein the voltage controller responds to a communication of the control unit concerning an imminent load change by changing the target value to a changed target value and the converter begins producing the input voltage for the high-frequency generator at the changed target value before occurrence of the imminent load change.

5. The method according to claim 4, wherein the target value is changed by an amount that is determined as a function of the size of the imminent load change.

6. The method according to claims 4, wherein the voltage controller responds to a communication of the control unit concerning an imminent load change by changing the target value in a plurality of steps.

7. The method according to claim 6, wherein at least one of the steps is performed prior to the ignition of the corona discharge and at least one of the steps is performed after the ignition of the corona discharge.

8. The method according to claim 4, wherein the voltage controller responds to a communication of the control unit concerning an imminent load change by changing the target value in a ramp-like manner during a period from 2 microseconds to 400 microseconds.

* * * * *